US005089854A

United States Patent [19]

Kaieda et al.

[11] Patent Number: 5,089,854

[45] Date of Patent: Feb. 18, 1992

[54] APPARATUS FOR SUPPLEMENTING DEVELOPING AGENT INTO IMAGE FORMING MACHINE

[76] Inventors: Shozo Kaieda, 776-6 Higashiasakawa-cho, Hachioji-City, Tokyo; Kazuaki Toyota, Center Bldg. 701, 1-8906 Fuchu-cho, Fuchu-city, Tokyo, both of Japan

[21] Appl. No.: 649,699

[22] Filed: Feb. 1, 1991

[30] Foreign Application Priority Data

Feb. 19, 1990 [JP] Japan ..... 2-37763

[51] Int. Cl.[5] ..... G03G 15/08

[52] U.S. Cl. ..... 355/260; 222/DIG. 1; 141/346; 141/364; 141/383

[58] Field of Search ..... 355/260; 141/346, 363, 141/364, 383, 386; 222/DIG. 1, 561

[56] References Cited

U.S. PATENT DOCUMENTS 4,060,105 11/1977 Feldeisen et al. ..... 141/363 X
4,304,273 12/1981 Caudill et al. ..... 141/364 X
4,942,432 7/1990 Mort et al. ..... 355/260

FOREIGN PATENT DOCUMENTS 63-32574 2/1988 Japan ..... 355/260

*Primary Examiner*—Joan H. Pendegrass

[57] ABSTRACT

An apparatus for supplementing a toner into a toner hopper of a developing device using the toner including a toner supplementing container having a toner bottle having an opening, a shutter member movable between a close position in which the opening of the toner bottle is closed by the shutter member and an open position in which the opening of the toner bottle is not closed by the shutter member, and a shutter locking member for locking the shutter member into the close position; and a container fixing and locking mechanism arranged on the toner hopper and having a fixing member for fixing the toner supplementing container onto the toner hopper and a locking member which is movable into a locked position in which the shutter locking member is released to allow the movement of the shutter member into the open position and the toner supplementing container could not be removed from the toner hopper and an unlocked position in which the toner supplementing container can be removed from the toner hopper and the shutter member is locked in the close position. When the shutter member is moved into the open position, the user could not handle the container locking member, because the container locking member is hidden by the shutter member. In this manner, the toner can be positively and easily supplemented into the developing device by means of the toner hopper without causing undesired spread of the toner.

11 Claims, 8 Drawing Sheets

APPARATUS FOR SUPPLEMENTING DEVELOPING AGENT INTO IMAGE FORMING MACHINE

BACKGROUND OF THE INVENTION

Field of the Invention and Related Art Statement

The present invention relates generally to an apparatus for supplementing a developing agent such as a toner for use in an image forming machine such as electrophotographic machine and printing machine, and more particularly to a combination of a developing agent supplementing container for containing a developing agent to be supplied to a hopper of a developing device provided in an image forming machine such as electrophotographic machine and printing machine and a mechanism for fixing and locking the developing agent container onto the hopper In an image forming apparatus using a two-component developing agent for use in the electrophotographic machine or printing machine, it is necessary to supplement a toner when an amount of the residual toner in the image forming machine is reduced below a predetermined amount. To this end, a developing device of the image forming machine usually comprises a toner hopper, and the toner contained in the toner supplementing container is supplied into the toner hopper. In this manner the toner contained in the toner supplementing container can be supplied into the developing device via the toner hopper.

In a known toner supplementing container comprises a toner bottle having an opening formed in a cap portion, a sealing member for sealing the opening of the toner bottle and a cap which is screwed onto the cap portion of the toner bottle. When the toner is to be supplemented, the cap and seal member are removed from the toner bottle and the toner is supplied into the toner hopper by tilting the toner bottle.

In the electrophotographic machine and printing machine of low or middle speed type, the toner consumption is low, so that an amount of the toner to be supplemented into the toner hopper is relatively small, so that the toner bottle has a small capacity. Therefore, the toner use can be easily supplemented into the toner hopper by grasping the toner bottle.

However, in the machine having a high printing speed, a large amount of toner has to be supplemented. For instance, it is sometimes necessary to supplement the toner more than 1.5 liters at one time. When such a large amount of the toner has to be supplemented, the toner bottle is large and heavy, so that it is quite difficult to supplement the toner correctly into the toner hopper, and the toner is liable to be spread beyond toner hopper.

In order to mitigate the above mentioned drawback it has been proposed to provide a removal shutter plate at the opening of the toner bottle. After the toner bottle has been set on the toner hopper, the shutter plate is removed from the opening to supply the toner into the toner hopper. However, in this case if the toner bottle is removed from the toner hopper before all the toner contained in the toner bottle has been supplied into the toner hopper, the remaining toner might be spread in the surrounding. It is apparent that such a spread of the toner is based on mishandling of the user, but in practice, such a mishandling is liable to occur so easily and so often. Therefore, it is necessary to provide any means for preventing such a spread of toner during the supplement of the toner into the toner hopper.

SUMMARY OF THE INVENTION

The present invention has for its object to provide a novel and useful apparatus for supplementing a developing agent contained in a developing agent supplementing container into a developing device by means of a developing agent hopper in a positive and easy manner without causing the undesired spread of the developing agent.

It is another object of the invention to provide a developing agent container in which a shutter member for closing an opening of a developing agent bottle is usually locked into a closed position, but can be moved into an open position only when the developing agent bottle is fixed and locked onto a developing agent hopper of a developing device.

It is still another object of the invention to provide an apparatus for supplementing a developing agent contained in a developing agent supplementing container into a developing device by means of a developing agent hopper, in which when the developing agent container is fixed on the hopper and a shutter member of the developing agent container is in an open position, a release of a locking member for locking the developing agent container onto the hopper is prevented effectively.

According to one aspect of the invention, an apparatus for supplementing a developing agent into a hopper of an image forming machine using a developing agent comprises:

a developing agent container including a bottle for containing the developing agent to be supplemented to the image forming machine and having an opening, a shutter member arranged movably between a close position in which said opening of the bottle is closed by the shutter member and an open position in which said opening of the bottle is not closed by the shutter member, and a shutter locking means for locking the shutter member in said close position;

a fixing means arranged on said hopper for fixing said developing agent container to the hopper when the developing agent container is placed on the hopper; and a container locking means arranged on the hopper movably into a locked position in which said fixing means is driven such that said developing agent container is locked on the hopper and said shutter locking means of the developing agent container is released to allow the movement of said shutter member of the developing agent container into said open position and an unlocked position in which said fixing means is driven such that said developing agent container can be removed from the hopper and said shutter locking means is unreleased so that said shutter member of the developing agent container could not be moved into said open position.

According to further aspect of the invention, a developing agent supplementing container comprises:

a bottle for containing a developing agent therein and having an opening through which the developing agent can be supplied into a hopper provided in an image forming machine using the developing agent;

a shutter member provided at the opening of bottle and being arranged movably into a close position for closing said opening of bottle and an open position for opening said opening of bottle; and a locking member for locking the shutter member when the shutter member is in said close position;

whereby said locking member is released by a fixing member provided on the hopper when said fixing member is in a locked position for locking the developing agent supplementing container onto the hopper.

DETAILED EXPLANATION OF THE PREFERRED EMBODIMENTS

Figure 1:
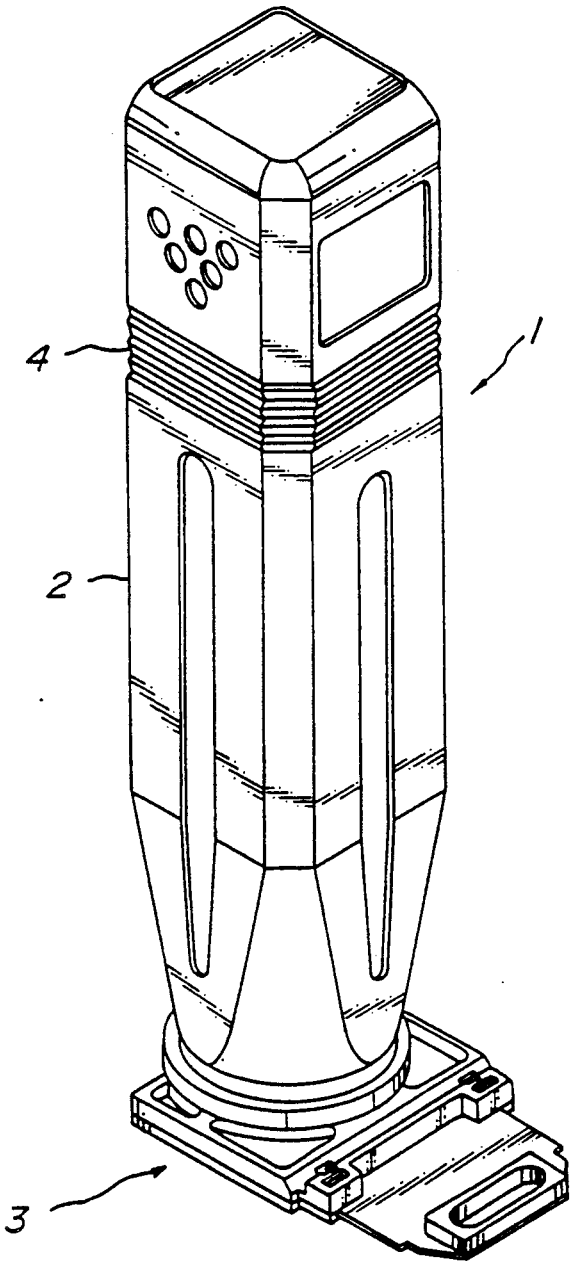
FIG. 1 is a perspective view showing an embodiment of the developing agent supplementing container according to the invention.
Figure 2:
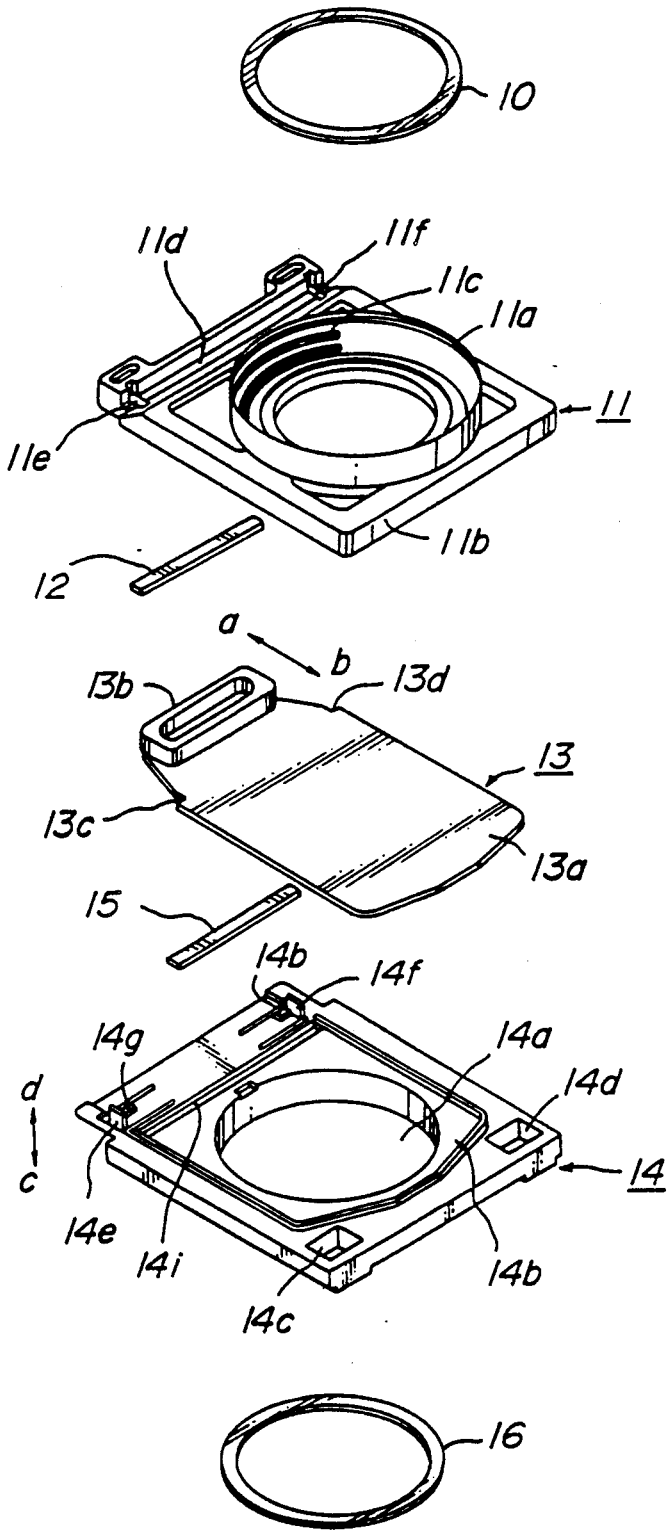
FIG. 2 is an exploded perspective view illustrating the mechanism for closing the opening of toner bottle.

FIG. 1 is a perspective view showing an embodiment of the developing agent supplementing container according to the invention, and FIG. 2 is an exploded perspective view illustrating the construction of a shutter member for closing and opening an opening of developing agent bottle. In the present embodiment, the developing agent supplementing container 1 contains a toner of the two-component type developing agent, so that the container is called a toner supplementing container. However, the present invention is not restricted to such a toner, but any kind of dry developing agent may be used. The toner supplementing container 1 according to the invention comprises a toner bottle 2 having an opening formed in a cap portion at its lower end, and a mechanism 3 for closing and opening the opening of toner bottle, said closing and opening mechanism 3 being secured to the cap portion of the toner bottle 2. The toner bottle 2 includes a bellows 4 which may be extended and shrunk in the longitudinal direction. Therefore, the toner contained in the toner bottle 2 can be effectively ejected out of the toner bottle by pushing the top portion thereof downward.

As shown in FIG. 2, the closing and opening mechanism 3 comprises an O-shaped seal 10 by means of which a first base member 11 is tightly screwed onto the cap portion of the toner bottle 2. The first base member 11 includes a cap portion 11*a* having a central opening formed therein, and a rectangular frame portion 11*b*. In the inner surface of the cap portion 11*a* there are formed female screw threads 11*c* which are engaged with male screw threads formed on the outer surface of the cap portion of the toner bottle 2. The size of the central hole formed in the cap portion 11*a* of the first base member 11 corresponds to the diameter of the opening formed in the cap portion of the toner bottle 2. In one side of the frame portion 11*b* of the first base member 11 there is formed a groove 11*d*. As will be explained later, a fixing spring is inserted into this groove 11*d*. Near both ends of the groove 11*d* there are formed rectangular through holes 11*e* and 11*f*. As will be explained later, locking claws for locking a shutter member are inserted into the holes 11*e* and 11*f*.

In the rear surface of the first base member 11 there is further formed a groove (not shown) into which a felt plate 12 serving as a seal is inserted. On the rear surface of the first base member 11 is arranged a shutter member 13. On the rear surface of the shutter member 13 is further arranged a second base member 14 by means of a felt seal 15. In this manner the shutter member 13 is slidably arranged between the first and second base members 11 and 14. The shutter member 13 serves to close the opening of toner bottle 2 and includes shutter plate 13*a* and a handle 13*b* provided on one end of the shutter plate. The user can move the shutter plate 13*a* in directions a and b by grasping the handle 13*b* with fingers. The shutter plate 13*a* has locking shoulders or steps 13*c* and 13*d* formed in both side edges thereof.

The second base member 14 comprises a circular through hole 14*a* and a depressed portion 14*b* in which the shutter plate 13*a* is inserted slidably. The second base member 14 further comprises two recesses 14*c* and 14*d* into which positioning projections (not shown) formed in the rear surface of the first base member 11 are inserted. The second base member 14 further includes a pair of locking claws 14*e* and 14*f* and a pair of locking pins 14*g* and 14*h*. The locking claws 14*e* and 14*f* are formed at tips of resilient strips so that they can be resiliently moved up and down in directions c and d as shown by a double headed arrow. The locking pins 14*g* and 14*h* are provided on the locking claws 14*e* and 14*f*, respectively, so that they are also movable in the up and down directions c and d together with the locking claws. The locking pins 14*g* and 14*h* are formed at such position that they are engaged with the locking shoulders 13*c* and 13*d* formed in the shutter plate 13*a* so that the movement of the shutter plate 13*a* in the direction a can be prevented by the engagement of the locking pins with the locking shoulders. It should be noted that the locking claws and pins may be formed integrally with a main body of the second base member by a molding of plastic material, or may be formed by L-shaped member made of resilient metal such as stainless steel and phosphor bronze. The second base member 14 further comprises a groove 14*i* extending in the direction perpendicular to the movable direction of the shutter member 13 and a felt plate 15 is inserted into the recess. This felt plate 15 also serves as a sealing member when the shutter member is pulled into the open position. On the rear surface of the second base member 14 is arranged an O-shaped seal 16 and a cap (not shown) is tightly screwed onto the cap portion of the toner bottle 2 by means of this seal.

The closing and opening mechanism 3 of the toner supplementing container 1 may be assembled in the following manner.

At first, the seal 10 is placed on a bottom wall of the cap portion 11*a* of first base member 11, and the felt plates 12 and 15 are inserted into the grooves formed in the first and second base members 11 and 14, respectively. Then, after the shutter member 13 has been placed in the depressed portion 14*b* of the second base member 14, the first and second base members 11 and are coupled with each other. In this manner the shutter member 13 is slidably arranged between the first and second base members 11 and 14, so that the these base members also form the guide for guiding the shutter member slidably. Upon assembling the first and second base members 11 and 14, the locking claws 14*e* and 14*f* of the second base member 14 are inserted into the through holes 11*e* and 11*f* of the first base member 11, respectively and at the same time the locking pins 14*g* and 14*h* of the second base member 14 are engaged with the locking shoulders 13*c* and 13*d* of the shutter member 13, respectively. Therefore, when the shutter member 13 is in the close position for closing the opening of the toner bottle 2,. the shutter member is locked by the locking pins 14*g* and 14*h* as long as the locking claws 14*e* and 14*f* are moved in the direction c and the engagement of the locking pins 14*g* and 14*h* with the locking shoulders 13*c* and 13*d* is released. When the locking is released, the shutter member 13 may be pulled in the direction a so that the opening of the toner bottle is opened and the toner contained in the toner bottle may be discharged out of the toner bottle through the opening. It should be noted that since the locking claws 14*g* and 14*h* are projected in the thin engaging recesses by a very small amount such as several millimeters, the locking condition is hardly released unless the locking claws are depressed by means of a special tool such as thin pin or bar, and therefore the locking condition could not be released accidentally.

Figure 3:
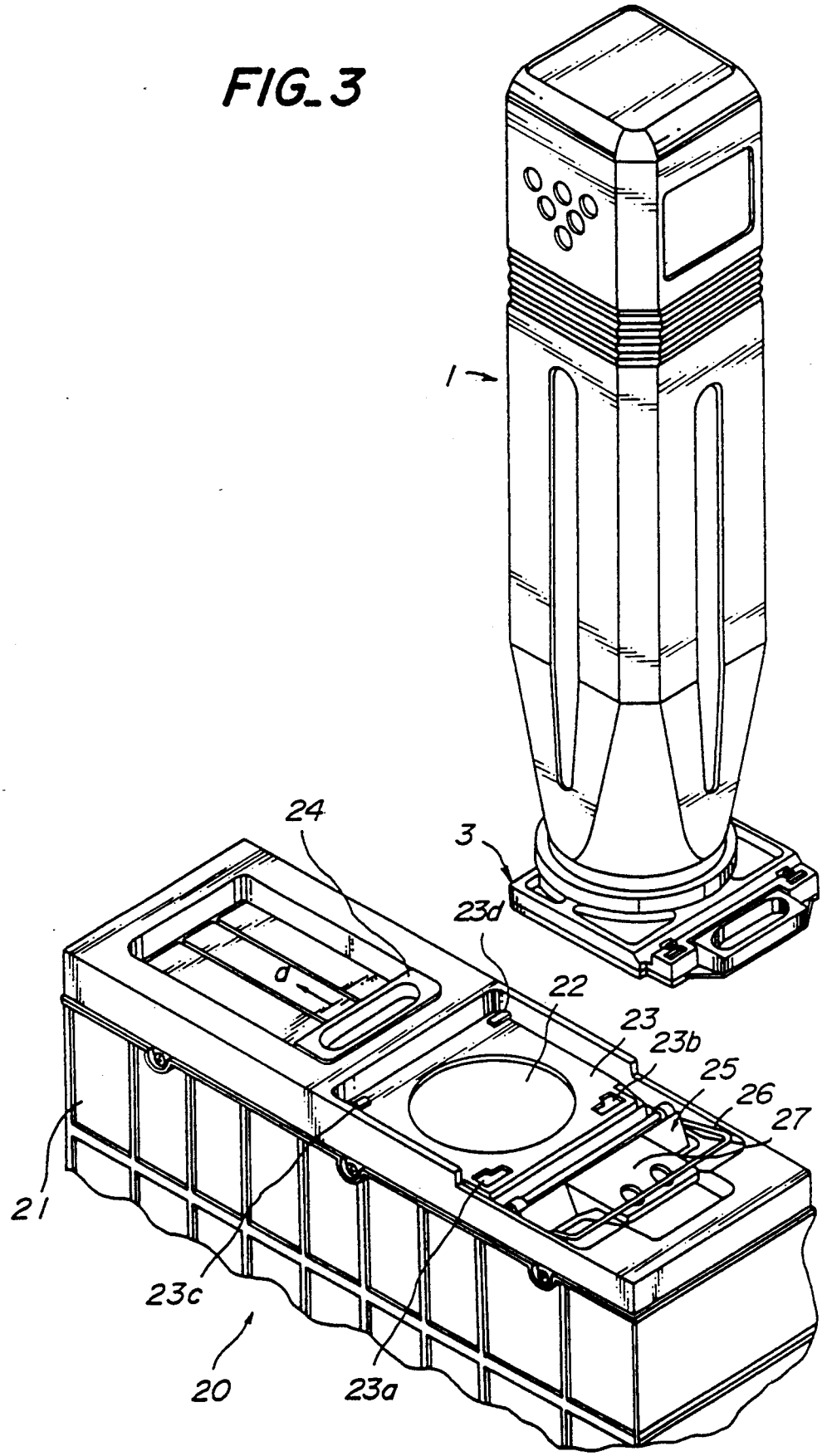
FIG. 3 is a perspective view depicting the construction of the fixing and locking mechanism provided on the toner hopper.
Figure 6:
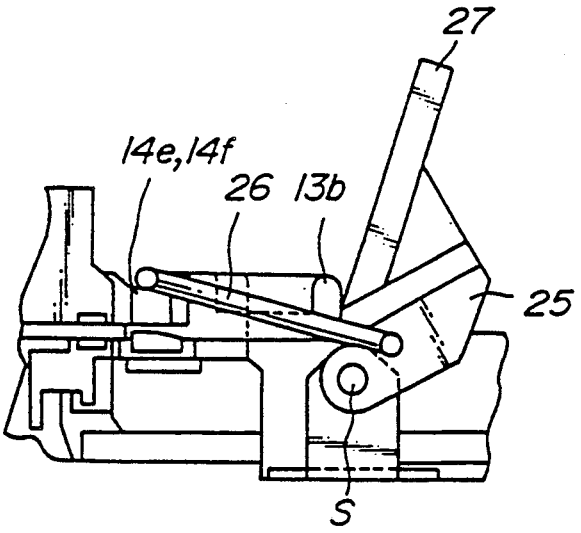
FIG. 6 is a side view depicting the fixing and locking mechanism provided on the toner hopper.

Now the construction of the toner hopper for receiving the toner container will be explained. As illustrated in FIG. 3, the toner hopper 20 comprises a housing 21 for containing the toner and a circular opening 22 formed in an upper plate of the housing. Around the opening 22 there is formed a depressed portion 23 which has such a dimension that it can receive the closing and opening mechanism 3 of the toner supplementing container 1. In the depressed portion 23 there are formed two L-shaped engaging holes 23*a* and 23*b* and two engaging projections 23*c* and 23*d*. When the toner supplementing container 1 is placed on the housing 21 of the toner hopper 20, the projections 23*c* and 23*d* formed on the toner hopper are inserted into recesses formed in the rear surface of the second base member 14 of the toner supplementing container, and at the same time projections formed on the rear surface of the second base member 14 of the toner supplementing container are inserted into the recesses 23*a* and 23*b* formed in upper surface of the housing 21 of the toner hopper 20. In this manner the toner supplementing container 1 can be positioned correctly with respect to the toner hopper 20. A shutter member 24 arranged slidably on the housing 21 is moved in the direction a to open the opening 22. On the housing 21 there is further arranged a fixing and locking mechanism near the depressed portion 23. This fixing and locking mechanism comprises a holder 25 which is rotatably secured to the housing 21 by means of shafts S shown in FIG. 6. To the holder 25 is rotatably secured a fixing spring 26. Further a locking member 27 is integrally formed with the holder 25. As best shown in FIG. 6, the fixing spring 26 is journaled to the holder 25 at a position which is shifted from a position at which the holder 25 is journaled to the housing 21.

Now the operating steps for fixing and locking the toner supplementing container 1 onto the toner hopper 20 will be explained with reference to FIGS. 4 to 8.

At first, the shutter member 24 of the toner hopper 20 is pulled in the direction a to open the opening 22 formed in the housing 21 of the toner hopper.

Figure 4:
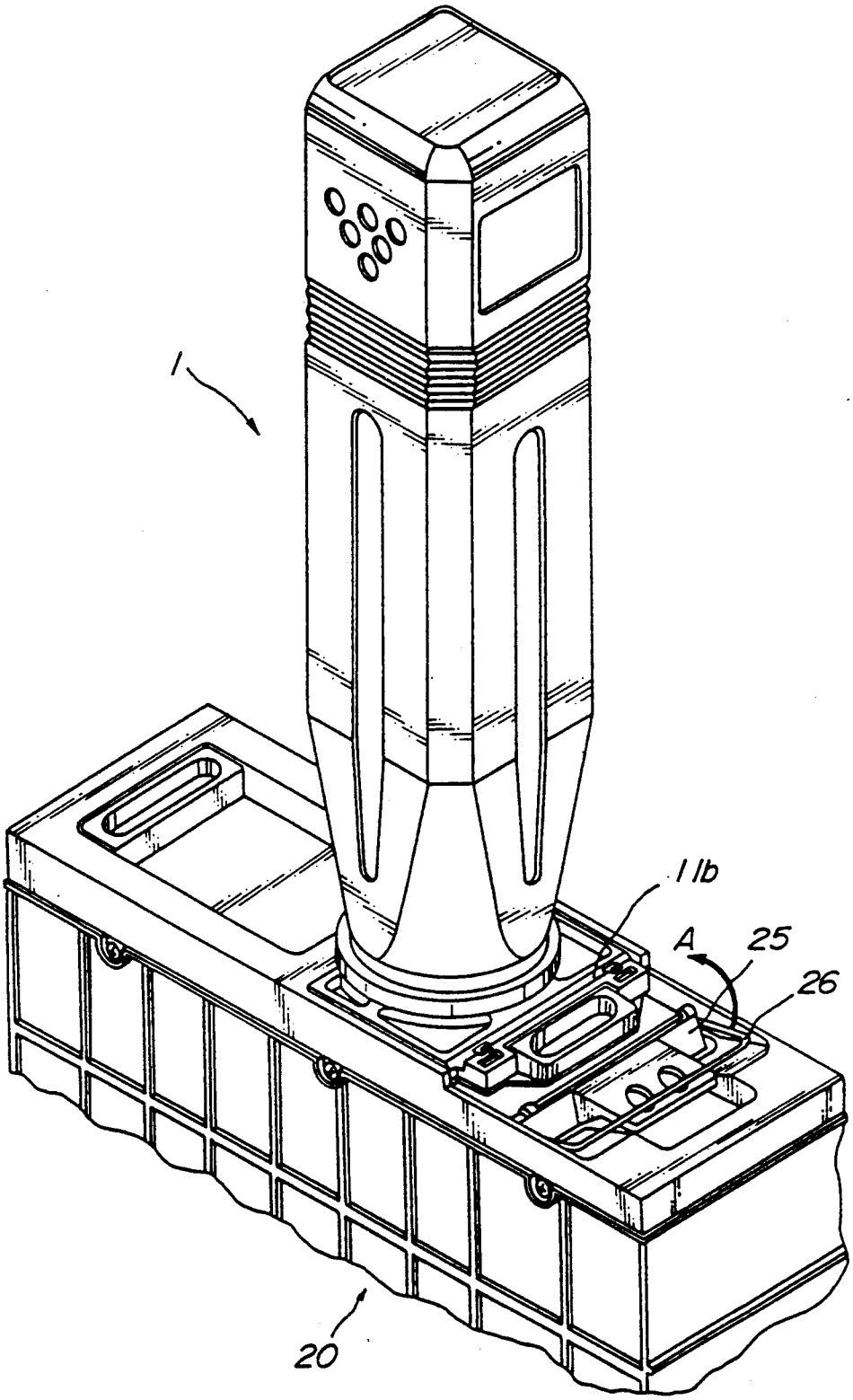
FIGS. 4 and 5 are perspective views showing the condition in which the toner supplementing container is placed on the toner hopper.
Figure 5:
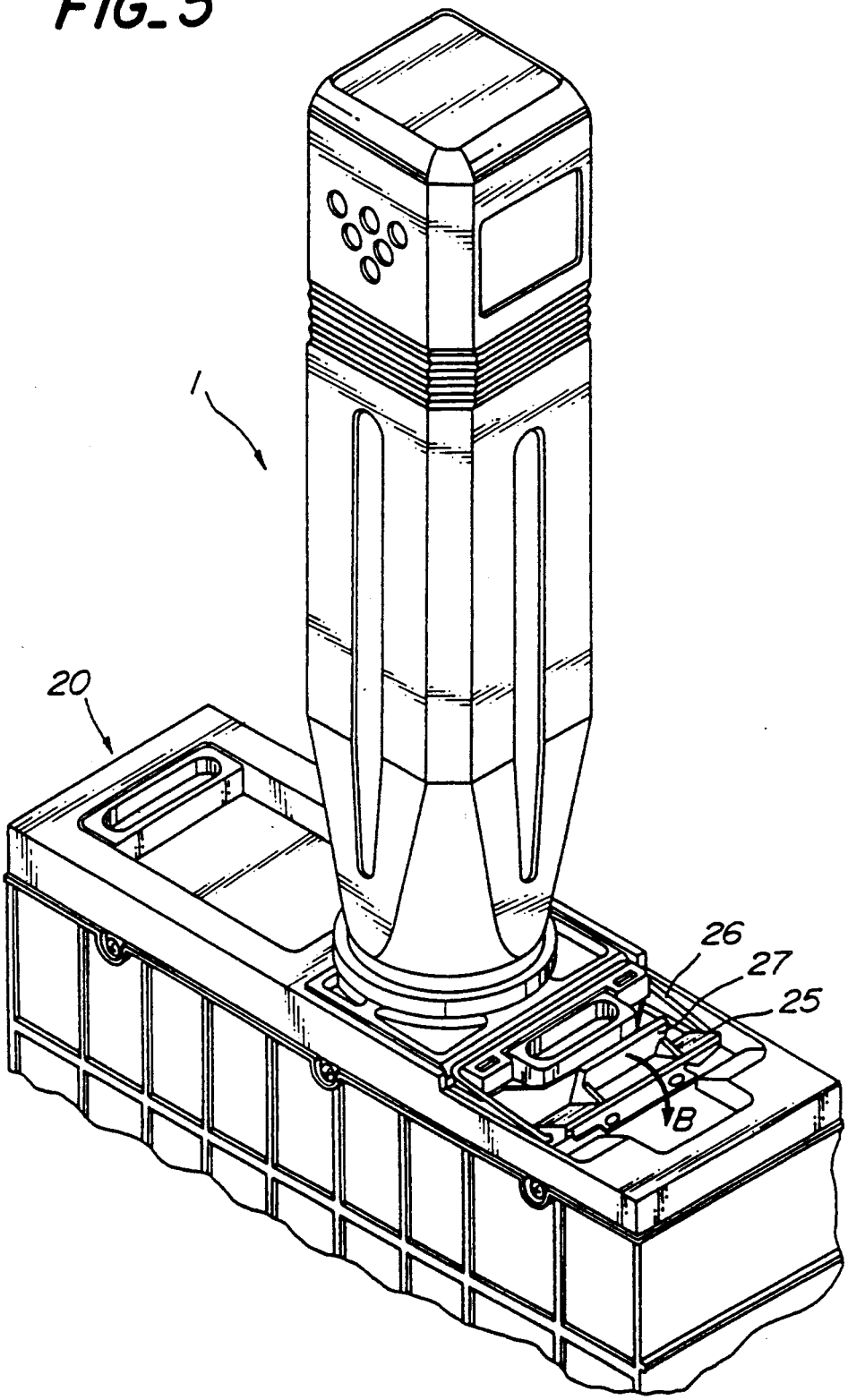

Next, the toner supplementing container 1 is placed on the toner hopper 20 as shown in FIG. 4. It should be noted that the toner supplementing container is placed in position by the engagement of the recesses 23*a*, 23*b* and projections 23*c*, 23*d* on the toner hopper 20 with the corresponding projections and recesses formed on the toner supplementing container 1. Then, the holder 25 and locking member 27 are rotated in the direction shown by an arrow A in FIG. 4 and the fixing spring 26 is further rotated in the direction A until it is inserted into the locking groove 11*d* formed in the first base member 11 of the toner supplementing container. This condition is illustrated in FIG. 5. In this condition the fixing spring 26 is just made into contact with the locking claws 14*e* and 14*f* formed in the second base member 14 of the toner supplementing container, but the locking claws are not depressed by the fixing spring, so that the engagement of the locking pins 14*g* and 14*h* with the locking shoulders 13*c* and 13*d* of the shutter member 13 is not released. Therefore, the shutter member 13 could not be pulled and the opening of the toner bottle 2 is still closed by the shutter member. Further, since the holder 25 and locking member 27 of the toner hopper are in substantially upright position as shown in FIG. 6, the shutter member 13 could not be pulled even if the above mentioned engagement of the locking pins with the locking shoulders is released accidentally by any reason.

Figure 7:
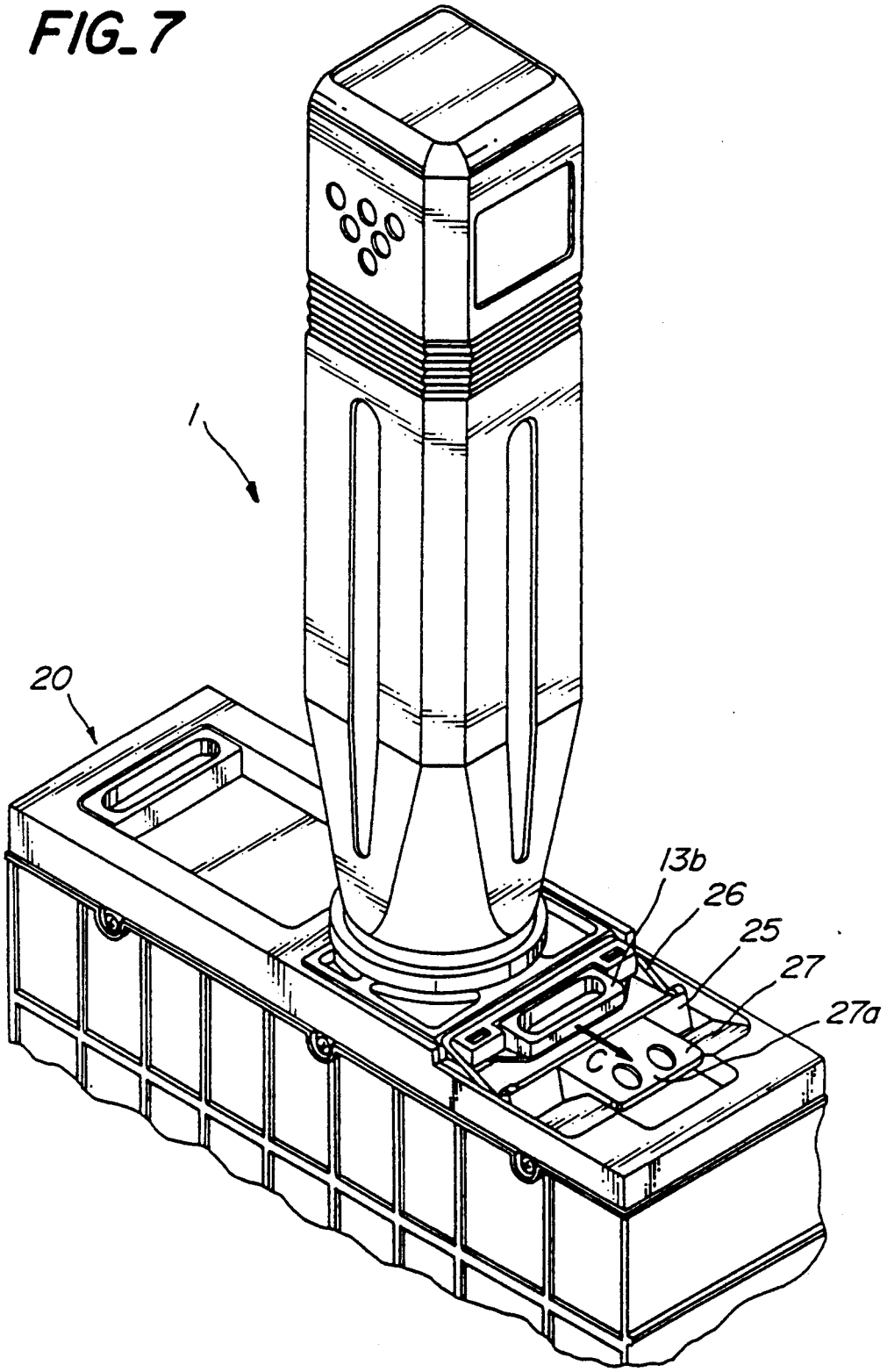
FIG. 7 is a perspective view illustrating the condition in which the toner supplementing container is locked on the toner hopper.

Next the holder 25 and locking member 27 are rotated in the direction shown by an arrow B in FIG. 5 to bring the fixing spring 26 into the locked condition When the holder 25 is rotated in the direction B, the journaled points of the fixing spring 26 are gradually moved downward and is resiliently clamped in the locking groove 11*d*. During this downward movement of the fixing spring 26, the locking claws 14*e* and 14*f* are pushed downward by the fixing spring, and thus the locking pins 14*g* and 14*h* are also moved downward such that the engagement of the locking pins with the locking shoulders 13*c* and 13*d* of the shutter member 13 is released. Therefore, the shutter member 13 may be pulled freely As depicted in FIG. 7, in the locked condition the locking member 27 is in such a position that its upper surface 27*a* is in the horizontal plane whose level is substantially same as the rear surface of the shutter member 13, so that the shutter member can be slid in a direction shown by an arrow C in FIG. 7 without being obstructed by the locking member 27.

Figure 8:
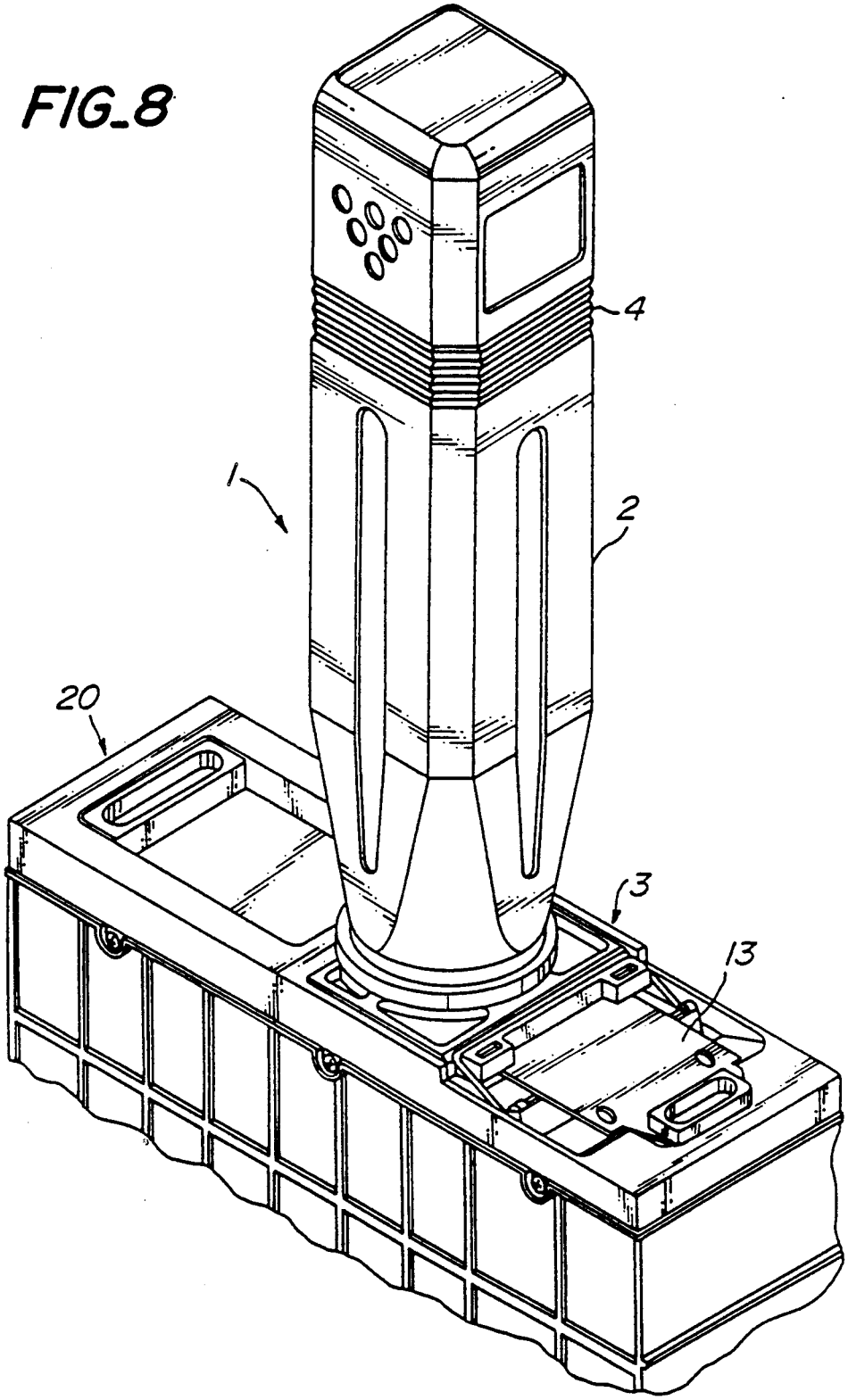
FIG. 8 is a perspective view showing the condition in which the shutter member is pulled out of the opening of toner bottle.

FIG. 8 illustrates the condition in which the shutter member 13 of the toner supplementing container 1 has been pulled to open the opening formed in the cap portion of the toner bottle 2. In this condition the toner contained in the toner bottle 2 is supplied into the toner hopper 20 by means of the openings of the toner bottle and toner hopper. It should be noted that in this locked condition, the shutter member 13 extends over the locking member 27, so that it is impossible to rotate the locking member into the unlocked position shown in FIG. 5. In other words, as long as the opening of the toner bottle 2 is not closed by the shutter member 13, the toner supplementing container 1 could never be removed from the toner hopper 20, and thus the toner could never be spread Next the operating steps for removing the toner supplementing container 1 from the toner hopper 20 will be explained.

At first, the shutter member 13 is pushed into the opening and closing mechanism 3 of the toner supplementing container 1 to close the opening of the toner bottle 2. Then, the locking member 27 is rotated in the direction A into the unlocked condition to release the locked condition of the fixing spring 26 with the toner supplementing container 1. Next, the fixing spring 26 is rotated in the direction B to release the engagement of fixing spring with the groove 11*d* formed in the first base member 11 of the toner supplementing container 1 is released. Then the toner supplementing container 1 is removed from the toner hopper 20. Finally, the shutter member 24 of the toner hopper 20 is moved to close the opening 22 of the toner hopper housing 21. According to the invention, before the toner supplementing container 1 is removed from the toner hopper 20, the opening of the toner bottle 2 has been closed by the shutter member 13 without fail, so that the remaining toner contained in the toner bottle could never be spread out of the toner bottle.

As explained above in detail, according to the instant invention the opening of the toner bottle of the toner supplementing container can be opened only when the toner supplementing container has been fixed and locked onto the toner hopper of the electrophotographic machine or printing machine, so that the undesired spread of the toner during the supplement of toner could be positively and easily prevented. Further the shutter member of the toner supplementing container could not be pulled to open the opening of the toner bottle unless the toner supplementing container has been fixed and locked onto the toner hopper, so that the opening of the toner bottle could never be pulled accidentally.

Further the locked condition of the toner supplementing container with the toner hopper could not be released after the opening of the toner bottle has been closed. Therefore, after the toner has been supplied into the toner hopper, the toner supplementing container can be removed from the toner hopper only after the opening of the toner bottle has been closed by the shutter member, so that the toner remained in the toner bottle could never be spread out of the toner bottle.

The present invention is not restricted to the above mentioned embodiment, but many modifications and alternations may be conceived by those skilled in the art within the scope of the invention. For instance, in the above embodiment the toner of the two-component type developing agent is supplemented, but the two-component type developing agent may be supplemented. Further the one-component type developing agent may be supplemented.

What is claimed is:

1. An apparatus for supplementing a developing agent into a hopper of an image forming machine using the developing agent comprising:

a developing agent container including a bottle for containing the developing agent to be supplemented to the image forming machine and having an opening, a shutter member arranged movably between a close position in which said opening of the bottle is closed by the shutter member and an open position in which said opening of the bottle is not closed by the shutter member, and a shutter locking means for locking the shutter member in said close position;

a fixing means arranged on said hopper for fixing said developing agent container onto the hopper; and a container locking means arranged on the hopper movably into a locked position in which said fixing means is driven such that said developing agent container is locked on the hopper and said shutter locking means of the developing agent container is released to allow the movement of said shutter member of the developing agent container into said open position and an unlocked position in which said fixing means is driven such that said developing agent container can be removed from the hopper.

2. An apparatus according to claim 1, wherein said container locking means comprises a portion which is situated in a moving path of the shutter member when the container locking means is in said unlocked position so that the shutter member could not be moved into said open position even if said shutter locking means is released accidentally.

3. An apparatus according to claim 2, wherein said said container locking means is arranged such that when the shutter member of the developing agent container is pulled in the open position, the movement of said container locking means into said unlocked position is inhibited by said shutter member.

4. An apparatus according to claim 3, wherein said shutter member includes a-shutter plate having locking shoulders formed in both sides thereof, and said shutter locking means includes first and second base members, said shutter member being arranged between said first and second base member slidably therebetween, said first base member having a through hole, a cap portion arranged around the through hole, said cap portion being secured to a cap portion of the bottle, and said second base member having a through hole which is aligned with the through hole of the first base member, locking pins arranged movably in a direction perpendicular to the plane of the shutter plate and being engaged with said locking shoulders formed in the shutter plate, the engagement of said locking pins with the locking shoulders being released by said fixing means when said container locking means is driven into the unlocked position.

5. An apparatus according to claim 4 wherein said fixing means comprises a holder secured rotatably to the hopper and a fixing spring which is secured to said holder at a position which is shifted from a position at which said holder is secured to the hopper.

6. An apparatus according to claim 5, wherein said first base member further comprises through holes into which said locking pins are inserted.

7. An apparatus according to claim 1, wherein developing agent container and fixing means further comprises positioning members for positioning the developing agent container on the hopper.

8. A developing agent supplementing container comprising:

a bottle for containing a developing agent therein and having an opening through which the developing agent can be supplied into a hopper provided in an image forming machine using the developing agent;

a shutter member provided at the opening of bottle and being arranged movably into a close position for closing said opening of bottle and an open position for opening said opening of bottle; and a locking member for locking the shutter member when the shutter member is in said close position; whereby said locking member is released by a fixing member provided on the hopper when said fixing member is in a locked position for locking the developing agent supplementing container onto the hopper.

9. A container according to claim 8, wherein said shutter member includes a shutter plate having locking shoulders formed in both sides thereof, and said shutter locking means includes first and second base members, said shutter member being arranged between said first and second base member slidably therebetween, said first base member having a through hole, a cap portion arranged around the through hole, said cap portion being secured to a cap portion of the bottle, and said second base member having a through hole which is aligned with the through hole of the first base member, locking pins arranged movably in a direction perpendicular to the plane of the shutter plate and being engaged with said locking shoulders formed in the shutter plate, the engagement of said locking pins with the locking shoulders being released by said fixing means when said container locking means is driven into the unlocked position.

10. A container according to claim 9, wherein said first base member further comprises through holes into which said locking pins are inserted.

11. A container according to claim 8, wherein said bottle comprises a bellows.

* * * * *